US007009462B2

(12) United States Patent
Kojima

(10) Patent No.: US 7,009,462 B2
(45) Date of Patent: Mar. 7, 2006

(54) LIMITER CIRCUIT

(75) Inventor: Haruo Kojima, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 79 days.

(21) Appl. No.: 10/785,064

(22) Filed: Feb. 25, 2004

(65) Prior Publication Data

US 2005/0024159 A1 Feb. 3, 2005

(30) Foreign Application Priority Data

Jul. 30, 2003 (JP) ..... 2003-203928

(51) Int. Cl.
*H01P 1/22* (2006.01)

(52) U.S. Cl. ..... 333/17.2; 333/81 R; 327/309

(58) Field of Classification Search ..... 333/17.2, 333/81 R; 327/309
See application file for complete search history.

(56) References Cited

U.S. PATENT DOCUMENTS 4,810,980 A * 3/1989 Heston et al. ..... 333/17.2
6,087,906 A * 7/2000 Lampel ..... 333/17.2

FOREIGN PATENT DOCUMENTS

JP 5-235677 9/1993
JP 05067934 * 7/2005

* cited by examiner

*Primary Examiner*—Stephen E. Jones
(74) *Attorney, Agent, or Firm*—Oblon, Spivak, McClelland, Maier & Neustadt, P.C.

(57) ABSTRACT

A limiter circuit comprises a quarter-wave transmission line, a first limiter element, a first DC return element, a second limiter element and a second DC return element. The quarter-wave transmission line, which has a predetermined characteristic impedance, comprises a signal line conductor and a common line conductor. The first limiter element is connected through a termination between the signal line conductor and the common line conductor at one side of the transmission line. The first DC return element is connected in parallel with the first limiter element. The second limiter element is connected between the signal line conductor and the common line conductor at another side of the transmission line. The second DC return element is connected to in parallel with the second limiter element.

3 Claims, 1 Drawing Sheet

LIMITER CIRCUIT

BACKGROUND OF THE INVENTION

1. Field of the Invention

The present invention relates to a limiter circuit, which is to be used in a device such as a pulse radar device.

2. Related Art

In such pulse radar device, a limiter circuit used for a high frequency band such as a microwave band is disposed, for example, between a radar antenna and a radar receiver of the pulse radar device so as to protect the radar receiver by preventing signals of excessively higher level, such as transmission signals leaking during the transmission of radar pulses and such as radar pulse signals reflected from a target existing in a short range, from being applied directly to the radar receiver.

Japanese Patent Laid-open Publication No. H5-235677 (hereinafter referred to as the "Prior Art Document 1") discloses, especially in FIG. 5, an example case where a PIN diode is used, as such a kind of limiter circuit, for a limiter-element. The above-mentioned example disclosed in the Prior Art Document 1 imparts an impedance matching function to a DC return element of the PIN diode to provide a lower insertion loss, even at a high frequency region, when small signals are inputted.

FIG. 2 also shows an example of the conventional limiter circuit in which an impedance matching is carried out at a predetermined frequency. The limiter circuit is composed of PIN diodes 11 and 12, DC return lines 13 and 14, and a $\lambda/4$ ($\lambda$denoting a wavelength) transmission line 15 including a signal line (side) conductor 15*a* and a common line (side) conductor 15*b*. This limiter circuit also includes a set of input terminals 16, i.e., a signal line (side) input terminal 16*a* and a common line (side) input terminal 16*b*, and a set of output terminals 17, i.e., a signal line (side) output terminal 17*a* and a common line (side) output terminal 17*b*.

The PIN diode 11 and the DC return line 13 are connected between the signal line input terminal 16*a* and the common line input terminal 16*b*. The PIN diode 11 has an anode, which is connected to the signal line input terminal 16*a*, and a cathode, which is connected to the common line input terminal 16*b*. On the other hand, the PIN diode 12 and the DC return line 14 are connected between the signal line output terminal 17*a* and the common line output terminal 17*b*. The PIN diode 12 has an anode, which is connected to the signal line output terminal 17*a*, and a cathode, which is connected to the common line output terminal 17*b*. Further, the signal line conductor 15*a* of the transmission line 15 is connected between the signal line input terminal 16*a* and the signal line-output terminal 17*a*, and the common line conductor 15*b* of the transmission line 15 is connected between the common line-input terminal 16*b* and the common line-output terminal 17*b*.

When a high frequency signal of low level is inputted to the set of input terminals 16 (16*a*, 16*b*) in the circuit having the above-described configuration, both the two PIN diodes 11 and 12 are made in a non-conducting state, and both the two DC return lines 13 and 14 provide a high impedance against the high frequency signal. As a result, the inputted high frequency signal propagated through the transmission line 15 is transmitted to the set of output terminals 17 (17*a*, 17*b*), with almost no occurrence of attenuation.

On the other hand, when a high frequency signal of high level is inputted to the set of input terminals 16, rectified currents 18*a* and 18*b* pass through the PIN diodes 11 and 12 via the DC return lines 13 and 14, with the result that both the PIN diodes 11 and 12 are made in a conducting state, and the transmission line 15 provides a high impedance against the high frequency signal. As a result, the inputted high frequency signal is reflected in a large amount, and only a slight amount of high frequency signal is inputted to the set of output terminals 17.

In this manner, the limiter circuit prevents an excessively large amount of signal from being inputted to a device such as a radar receiver, which is connected to the output terminals 17 of the limiter circuit on the downstream side thereof.

However, in the conventional limiter circuit of the structure described above, when the high frequency signal is inputted at a high level to the limiter circuit, such a signal is reflected towards the upstream side of the set of input terminals 16 of the limiter circuit. More specifically, a voltage standing wave ratio of the limiter circuit at the set of input terminals 16 is seriously deteriorated. The reflected signal further travels towards such devices or elements as antenna circuit, distributing circuit, and transmitting/receiving switching circuit, which are connected to the set of input terminals 16 of the limier circuit on the upstream side thereof. When such a signal further advances as being maintained at its high level, it may cause interference with the other high frequency signal system, thus providing an unfavorable influence on the signal processing operation and the signal processing results.

Especially, in an example in which there is provided a plurality of radar receivers in combination with an array antenna, the signal reflected from the limiter circuit may be adversely mixed into an input signal for the other radar receiver via devices, which are connected to the set of input terminals of the limiter circuit on the upstream side thereof, thus causing interference therewith. It is therefore difficult to obtain an expected antenna pattern or antenna gain.

SUMMARY OF THE INVENTION

An object of the present invention, which was conceived in consideration of the circumstances described above, is to provide a limiter circuit, permitting to prevent, even at a time when a high frequency signal of high level is inputted to the limiter circuit, such an input signal from being reflected to the other devices or like elements, which are connected to the input side of the limiter circuit on the upstream side thereof, thus providing an appropriate voltage standing wave ratio at the input side.

This and other objects can be achieved according to the present invention by providing a limiter circuit comprising:

a transmission line of quarter-wave length, which has a predetermined characteristic impedance, provided with a signal line conductor and a common line conductor;

a first limiter element connected, through a terminator, between the signal line conductor and the common line conductor at one side of the transmission line;

a first DC return element connected in parallel with the first limiter element;

a second limiter element connected between the signal line conductor and the common line conductor at another side of the transmission line; and a second DC return element connected to in parallel with the second limiter element.

In a preferred embodiment of the above aspect of the invention, each of the first and second DC return elements may comprise a high characteristic impedance line of a quarter-wave length.

Furthermore, each of the first and second limiter elements may be composed of a PIN diode.

The limiter circuit may further comprise signal line side input and output ends and common line side input and output ends, and the first DC return element has one end connected to the a portion between the common line side input end and the common line conductor and another end connected to a portion between the first limiter element and the terminator.

According to the limiter circuit of the present invention of the structure mentioned above, it is possible to prevent, even when a high frequency signal of high level is inputted to the limiter circuit, such an input signal from being reflected to the other devices or elements, which are connected to the input side of the limiter circuit on the upstream side thereof, thus providing an appropriate voltage standing wave ratio at the input side.

The nature and further characteristic features of the present invention will be made more clear from the following descriptions made with reference to the accompanying drawings.

DESCRIPTION OF THE PREFERRED EMBODIMENTS

A preferred embodiment of a limiter circuit according to the present invention will be described hereunder with reference to FIG. 1.

Figure 1:
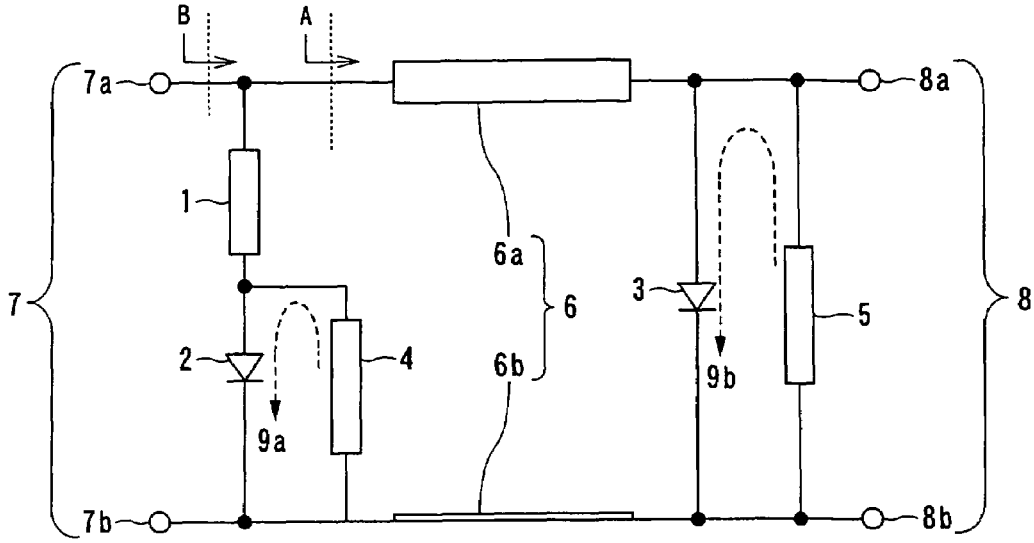
FIG. 1 is a circuit diagram illustrating a limiter circuit according to an embedment of the present invention.
Figure 2:
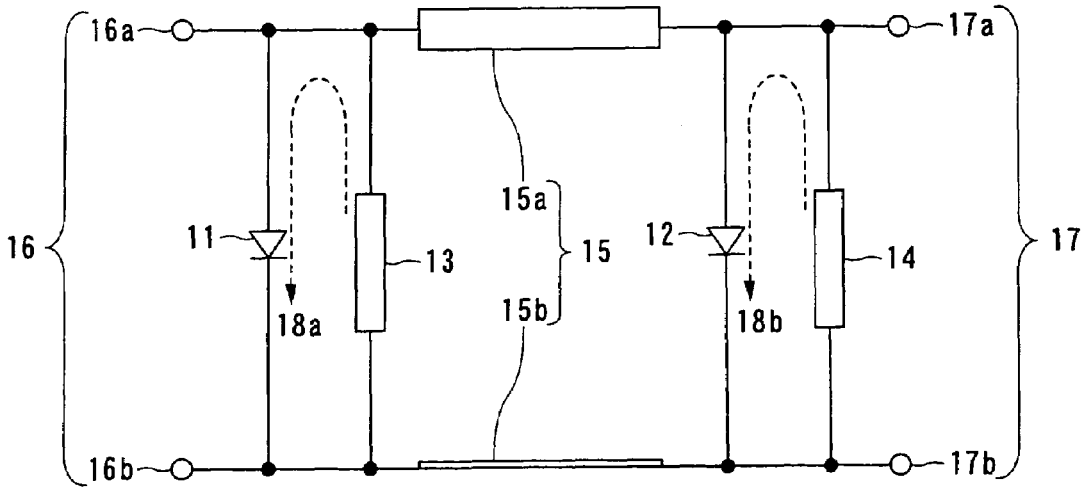
PRIOR ART FIG. 2
FIG. 2 is a circuit diagram illustrating an example of the conventional limiter circuit.

Referring to FIG. 1, a limiter circuit is composed of a terminator 1, a PIN diode 2 serving as a first limiter element, a PIN diode 3 serving as a second limiter element, a DC return line 4 serving as a first DC return element, a DC return line 5 serving as a second DC return element, and a transmission line 6 of λ/4 (λ denoting a wavelength, i.e., a quarter-wave length) (λ/4 transmission line 6) having a predetermined characteristic impedance. The transmission line 6 is provided with a signal line conductor 6*a* and a common line conductor 6*b*. The limiter circuit also includes a set of input terminals 7 and a set of output terminals 8. The set of input terminals 7 is composed of a signal line (side) input terminal 7*a* and a common line (side) input terminal 7*b*. The set of output terminals 8 is composed of a signal line (side) output terminal 8*a* and a common line (side) output terminal 8*b*.

The terminator 1 is connected between the signal line-input terminal 7*a* and an anode of the PIN diode 2 and acts to terminate the set of input terminals 7 with the predetermined characteristic impedance when a high frequency signal of high level is inputted. The PIN diode 2 is connected between one end of the termination 1 and the common line input terminal 7*b* so as to provide a non-conducting state when a high frequency signal of a low level is inputted or provide a conducting state to conduct the one end with the common line input terminal 7*b* when a high frequency signal of high level is inputted.

With respect to polarity of the PIN diode 2 in the embodiment of the present invention, the PIN diode 2 has an anode, which is connected to the terminator 1, and a cathode, which is connected to the common line input terminal 7*b*. The PIN diode 3 is connected between the signal line output terminal 8*a* and the common line output terminal 8*b* so as to provide a non-conducting state when a high frequency signal of a low level is inputted or provide a conducting state to make a short circuit between the signal line output terminal 8*a* and the common line output terminal 8*b* when a high frequency signal of high level is inputted.

On the other hand, with respect to polarity of the PIN diode 3 in the embodiment of the present invention, the PIN diode 3 has an anode, which is connected to the signal line output terminal 8*a*, and a cathode, which is connected to the common line input terminal 8*b*.

The DC return line 4 is connected in parallel with the PIN diode 2 so as to constitute a line for a rectified current 9*a*, which passes through the PIN diode 2 when a high frequency signal of high level is inputted.

In the embodiment of the present invention, the DC return line 4 is constituted by a λ/4 (λ denoting a wavelength) high characteristic impedance line so as to always provide a high impedance against the inputted high frequency signal. The DC return line 5 is connected in parallel with the PIN diode 3 so as to constitute a line for a rectified current 9*b*, which passes through the PIN diode 3 when a high frequency signal of high level is inputted. That is, this DC return element 4 has one end connected to the a portion between the common line input end 7*b* and the common line conductor 6*b* and the other end connected to a portion between the PIN diode as the first limiter element 2 and the terminator 1.

Furthermore, in the embodiment of the present invention, the DC return line 5 is also constituted by a λ/4 (λ denoting a wavelength) high characteristic impedance line so as to always provide a high impedance against the high frequency signal passing through the transmission line 6. According to this manner, the two DC return lines 4 and 5 are constituted by distributed constant lines, thus making it possible to form a stable path or line for the rectified current even at the high frequency region.

The signal line conductor 6*a*, which constitutes the transmission line 6, has one end connected to the signal line-input terminal 7*a* and the other end connected to the signal line output terminal 8*a*. The common line-conductor 6*b*, which also constitutes the transmission line 6, has one end connected to the common line input terminal 7*b* and the other end connected to the common line output terminal 8*b*. The transmission line 6 serves as a line having a predetermined characteristic impedance, when the high frequency signal of a low level is generated, to transmit the high frequency signal inputted to the set of input terminals 7 to the set of the output terminals 8. On the other hand, the transmission line 6 provide a high impedance to make interruption between the input terminals 7 and the output terminals 8, when the high frequency signal of high level is generated.

Now, an operation of the limiter circuit having the structure or configuration mentioned above, according to the embodiment of he present invention will be described hereunder with reference to FIG. 1.

When the high frequency signal of low level is generated from the set of input terminals 7, which is too low to be subjected to limitation, the PIN diode 2 is made in the non-conducting state. As a result, the terminator 1, which is connected to the set of input terminals 7, takes its open state at one end thereof, thus providing no function. In addition, the DC return line 4 provides the high impedance against the inputted high frequency signal. Further, the PIN diode 3 is also made in the non-conducting state and the DC return line 5 also provides the high impedance against the inputted high frequency signal. As a result, the high frequency signal transmitted from the set of input terminals 7 is propagated through the transmission line 6 with almost no occurrence of attenuation. At this instance, the limiter circuit serves as the transmission line merely having the predetermined characteristic impedance, with the result that the high frequency signal as inputted is not reflected towards the other devices or elements, which are connected to the set of input terminals 7 of the limier circuit on the upstream side thereof.

On the other hand, when the high frequency signal of a high level is transmitted from the set of input terminals 7, which is so high to be subjected to limitation, the rectified current 9*a* passes through the PIN diode 2 via the DC return line 4 so that the PIN diode 2 is made in the conducting state. As a result, the terminator 1 is conductively connected between the signal line input terminal 7*a* and the common line input terminal 7*b*. The rectified current 9*b* also passes through the PIN diode 3 via the DC return line 5 so that the PIN diode 3 is made in the conducting state.

At this stage of time, when looking the set of output terminals 8 from the point "A" in FIG. 1, i.e., a point on the side closer to the set of input terminals 7 of the transmission line 6, the transmission line 6 becomes the λ/4 transmission line having the front side, which is short-circuited by means of the PIN diode 3, thus providing a high impedance. Accordingly, a high frequency-interruption is made between the point "A" and the set of output terminals 8, with the result that the high frequency signal, having been largely attenuated, is generated from the set of output terminals 8.

On the other hand, when looking the set of output terminals 8 from the point "B" in FIG. 1, i.e., a point on the side of the set of input terminals 7, the transmission line 6 provides the high impedance as described above, though the terminator 1 is conductively connected with the transmission line 6. Accordingly, the set of input terminals 7 is terminated with the predetermined impedance by means of the terminator 1. As a result, the high frequency signal, which is inputted to the set of input terminals 7 at a high level, is terminated by means of the terminator 1, thus preventing the high frequency signal from being reflected towards the devices or elements connected to the set of the input terminals 7 of the limiter circuit on the upstream side thereof.

According to the limier circuit of the embodiment of the present invention, as mentioned above, the λ/4 transmission line 6 having the predetermined characteristic impedance can be provided with one end serving as an input end and the other end serving as an output end. Further, the PIN diode 2 is connected through the terminator 1 to this input end in parallel with the transmission line 6 and the PIN diode 3 is connected to this output end in parallel with the transmission line 6. Thus, both the two PIN diodes 2 and 3 can provide the non-conducting state against the high frequency signal inputted at the low level and also provide the conducting state against the high frequency signal inputted at the high level.

This makes it possible to cause the transmission line 6 to serve as the transmission line having the predetermined characteristic impedance against the high frequency signal inputted at the low level, thus obtaining an appropriate voltage standing wave ratio. On the contrary, against the high frequency signal inputted at the high level, the transmission line 6 is caused to serve as the transmission line having the high impedance, thus making it possible to output the remarkably attenuated signal and prevent the signal from being reflected towards the device, which is connected to the set of input terminals of the limier circuit on the upstream side thereof, by terminating the input end by means of the terminator 1, thus obtaining an appropriate voltage standing wave ratio.

Furthermore, in the present invention, each of the DC return lines 4 and 5, which are connected in parallel with the PIN diodes 2 and 3, respectively, is constituted by the λ/4 distributed constant line having the high characteristic impedance. This makes it possible to provide the line through which the rectified current may travel when the PIN diodes 2 and 3 are made and kept in the conducting state, so that no interference with the surroundings occurs even in the high frequency region, and the stability can thus be ensured.

In the above-described embodiment of the present invention, although each of the PIN diodes 2 and 3 has the cathode, which is connected to the side of the common line conductor 6*b*, the polarity may be reversed so that each of the PIN diodes 2 and 3 has the anode, which is connected to the side of the common line conductor 6*b* so as to provide substantially the same technical advantageous functions and effects.

It is to be noted that the present invention is not limited to the embodiment of the characters and structures mentioned above and other changes and modifications may be made without departing from the scopes of the appended claims.

What is claimed is:

1. A limiter-circuit comprising:

a transmission line of quarter-wave length which has a predetermined characteristic impedance, said transmission line comprising a signal line conductor and a common line conductor;

signal line input terminal connected to said signal line conductor;

signal line output terminal connected to said signal line conductor;

common line input terminal connected to said common line conductor;

common line output terminal connected to said common line conductor;

a terminator connected between said signal line input terminal and said common line input terminal;

a first limiter element connected in series with said terminator and between said terminator and said common line input terminal;

a first DC return element connected in parallel with the first limiter element and between said common line input terminal and a portion between the first limiter element and the terminator;

a second limiter element connected between said signal line output terminal and said common line output terminal; and a second DC return element connected to in parallel with the second limiter element.

2. A limiter-circuit according to claim 1, wherein:

each of said first and second DC return elements comprises a high characteristic impedance line of a quarter-wave length.

3. A limiter circuit according to claim 1, wherein each of said first and second limiter elements comprises a PIN diode.

* * * * *